US008167307B2

(12) United States Patent
Maeyama et al.

(10) Patent No.: US 8,167,307 B2
(45) Date of Patent: May 1, 2012

(54) IMAGE FORMING APPARATUS

(75) Inventors: Yuichiro Maeyama, Kanagawa (JP); Takayuki Niihara, Kanagawa (JP); Masahiko Yamada, Tokyo (JP); Masato Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/871,119

(22) Filed: Aug. 30, 2010

(65) Prior Publication Data

US 2011/0057380 A1 Mar. 10, 2011

(30) Foreign Application Priority Data

Sep. 7, 2009 (JP) ..... 2009-206390

(51) Int. Cl.
*B65H 5/02* (2006.01)
*B65H 5/04* (2006.01)

(52) U.S. Cl. ..... 271/276; 271/194; 271/196

(58) Field of Classification Search ..... 271/276, 271/194, 196, 197; 347/104
See application file for complete search history.

(56) References Cited

U.S. PATENT DOCUMENTS

| | | | |
|---|---|---|---|
| 2002/0110400 | A1 | 8/2002 | Beehler et al. |
| 2004/0174421 | A1 | 9/2004 | Tsuji |
| 2009/0266926 | A1 | 10/2009 | Yoshimaru et al. |

FOREIGN PATENT DOCUMENTS

| | | |
|---|---|---|
| EP | 1445112 A1 | 8/2004 |
| JP | 5-107969 | 4/1993 |
| JP | 2004-98319 | 4/2004 |
| JP | 3690182 | 6/2005 |

OTHER PUBLICATIONS

Dec. 3, 2010 European search report in connection with a counterpart European patent application.

*Primary Examiner* — David H Bollinger
(74) *Attorney, Agent, or Firm* — Cooper & Dunham LLP

(57) ABSTRACT

Disclosed is an image forming apparatus that includes an image forming unit that forms an image and a conveyance unit that conveys a medium to be recorded opposing the image forming unit. The conveyance unit includes a platen member that guides the medium to be recorded and has plural suction holes formed therein, plural air chambers that the plural suction holes formed in the platen member face, and plural suction units that suction air inside the plural air chambers through the suction holes. At least two or more of the plural air chambers are arranged in a direction crossing a conveyance direction of the medium to be recorded. One of the plural air chambers is connected to one of the plural suction units, and one or two or more of the plural air chambers is connected to at least one of the plural suction units.

9 Claims, 20 Drawing Sheets

IMAGE FORMING APPARATUS

BACKGROUND OF THE INVENTION

1. Field of the Invention

The present invention generally relates to image forming apparatuses and, in particular, to an image forming apparatus that conveys a medium to be recorded by air suction.

2. Description of the Related Art

As image forming apparatuses such as printers, facsimile machines, copiers, plotters, and multi-task machines having plural such functions, known ink jet recording apparatuses of a liquid ejection recording type use a recording head that ejects, for example, ink liquid droplets. The image forming apparatus of this type ejects ink droplets from the recording head onto a sheet during conveyance to perform image formation (used synonymously with recording, printing, and imaging). Further, an object on which ink droplets are ejected is not limited to a paper but includes an OHP sheet, etc., which is also referred to as a medium to be recorded, a recording medium, a recording sheet, a recording paper, etc. Examples of the image forming apparatus include a serial-type image forming apparatus in which the recording head ejects liquid droplets to form an image while moving in a main-scanning direction and a line-type image forming apparatus using a line-type head in which a recording head ejects liquid droplets to form an image without moving.

Note that in the embodiments of the present invention, the "image forming apparatus" of the liquid ejection recording type refers to an apparatus that ejects liquid droplets onto a medium such as paper, a thread, a fiber, a fabric, leather, metal, a plastic, glass, wood, and a ceramic so as to perform image formation. Further, the "image formation" refers to forming on a medium not only relevant images such as characters and graphics, but also irrelevant images such as random patterns (i.e., liquid droplets are just ejected onto a medium). Further, the "ink" is not particularly limited to one called ink so long as it turns into liquid at the time of ejection, but includes a DNA sample, a resist, a pattern material, etc. Further, the "image" is not particularly limited to a planer image, but includes an image on an object formed in three dimensions, and an image formed by three-dimensionally molding a figure. Further, the "image forming apparatus" is not particularly limited to a liquid ejection recording type, but includes one that performs image formation using an electrophotographic method. In the embodiments of the present invention, the image forming apparatus of a liquid ejection type is used.

As a conveyance unit (mechanism) that conveys a sheet as a medium to be recorded in such an image forming apparatus, there is known one that has plural suction holes formed in a conveyance belt or a platen member for guiding the sheet and suctions a chamber or a negative chamber provided at the back surface of the conveyance belt or the platen member by a suction unit such as a suction fan, so that the sheet is air-attracted to the conveyance belt and the platen member and conveyed.

In such a conveyance unit using the air suction, a suction force to the sheet is reduced as the opening areas of the suction holes formed in the conveyance belt and the platen member increase. Therefore, it is likely that the tip end part and the rear end part of the sheet float.

For addressing this problem, for example, Patent Document 1 proposes a sheet conveyance unit in which an air chamber provided at the back surface of a platen member is divided into plural pieces of air chambers in a sheet conveyance direction, suction fans are provided so as to correspond to the air chambers, and a negative pressure is generated only in selected ones in any of the desired air chambers. Further, Patent Document 2 proposes a sheet conveyance unit in which a conveyance belt is divided into plural pieces of conveyance belts in a direction orthogonal to a sheet conveyance direction (i.e., sheet-width direction), air chambers respectively divided in the sheet-width direction are provided at the back surfaces of the conveyance belts, one suction fan and valves that open and close suction paths for connecting the air chambers to the suction fan are provided, and only selected ones of any of the desired air chambers is operated in accordance with a sheet size. Further, Patent Document 3 proposes an ink jet recording apparatus provided with a unit that opens and closes suction holes formed in a platen member in accordance with a sheet width in a sheet-width direction.

Patent Document 1: JP-B-3690182

Patent Document 2: JP-A-5-107969

Patent Document 3: JP-A-2004-098319

As disclosed in Patent Document 2, the air chamber is divided into the plural pieces of air chambers in the sheet-width direction, and the occurrence of a negative pressure in the air chambers is controlled by the one fan and the valve provided in the respective suction paths. According to this configuration, the sheet conveyance unit becomes complicated in its configuration, and the suction fan serving as a source for generating a negative pressure is commonly used. Therefore, the occurrence of a negative pressure (occurrence of a suction force) cannot be finely controlled so as to correspond to the cases of the air chamber where all the suction holes are sealed by the sheet, the air chamber where some of the suction holes are sealed by the sheet, and the air chamber where the suction holes are not sealed by the sheet at all.

SUMMARY OF THE INVENTION

The present invention has been made in view of the above problems and may have an object of generating an appropriate suction force in accordance with the size of a medium to be recorded.

According to an embodiment of the present invention, there is provided an image forming apparatus including an image forming unit that forms an image; and a conveyance unit that conveys a medium to be recorded opposing the image forming unit. The conveyance unit includes a platen member that guides the medium to be recorded and has plural suction holes formed therein, plural air chambers that the plural suction holes formed in the platen members face, and plural suction units that suction air inside the plural air chambers through the suction holes. At least two or more of the plural air chambers are arranged in a direction crossing a conveyance direction of the medium to be recorded. One of the plural air chambers is connected to one of the plural suction units, and one or two or more of the plural air chambers is connected to at least one of the plural suction units.

Other objects, features and advantages of the present invention will become more apparent from the following detailed description when read in conjunction with the accompanying drawings.

DETAILED DESCRIPTION OF THE PREFERRED EMBODIMENTS

Figure 1:
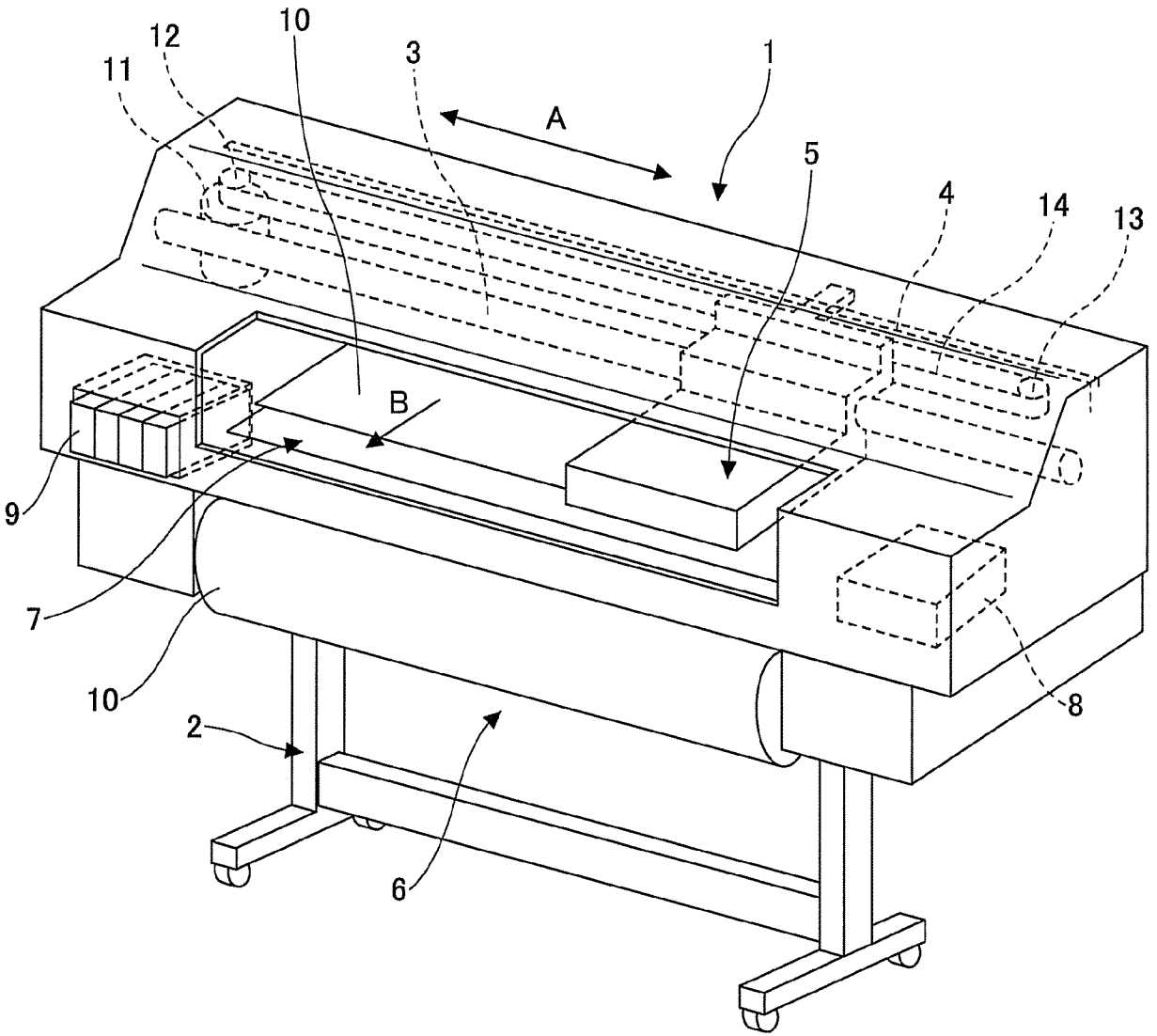
FIG. 1 is a perspective explanatory view showing the entire configuration of an ink jet recording apparatus serving as an image forming apparatus relating to the embodiments of the present invention.

Hereinafter, the embodiments of the present invention are described with reference to the accompanying drawings. Referring to FIG. 1, a description is made of an example of an ink jet recording apparatus serving as an image forming apparatus according to the embodiments of the present invention. Note that FIG. 1 is a perspective explanatory view showing the entire configuration of the ink jet recording apparatus.

The ink jet recording apparatus is a serial-type ink jet recording apparatus and has a recording apparatus main body 1 and a supporting base 2 that supports the recording apparatus main body 1.

Inside the recording apparatus main body 1, a guide rod 3 and a guide rail 4 are bridged between both side plates (not shown), and a carriage 5 is slidably held by the guide rod 3 and the guide rail 4 in the direction as indicated by an arrow A.

The carriage 5 has mounted thereon a recording head 21 (see FIG. 2) composed of a liquid ejection head that ejects respective colors of ink droplets of black (K), yellow (Y), magenta (M), and cyan (C). Although not shown, a sub-tank that supplies ink to the recording head is integrated with the recording head.

A main-scanning mechanism that moves the carriage 5 for scanning has a driving motor 11 arranged on one side in a main-scanning direction, a driving pulley 12 driven to rotate by the driving motor 11, a driven pulley 13 arranged on the other side in the main-scanning direction, and a belt member 14 bridged between the driving pulley 12 and the driven pulley 13. Note that the driven pulley 13 is outwardly urged by a tension spring (not shown) (in a direction away from the driving pulley 12). The belt member 14 tows the carriage 5 in the main-scanning direction with its part fixed to and held by a belt fixing part provided at the back surface of the carriage 5.

Further, an encoder sheet (not shown) is arranged to detect the main-scanning position of the carriage 5 along the main-scanning direction of the carriage 5. The position of the carriage 5 is detected in such a manner that the encoder sheet is read by an encoder sensor 22 (see FIG. 5) provided in the carriage 5. Further, the carriage 5 has a sheet sensor 23 (see FIG. 5) that detects the tip end of the sheet 10, both ends in the width direction thereof, etc.

In the recording region of the main-scanning region of the carriage 5, the sheet 10 is intermittently conveyed by a suction conveyance unit 7 in the direction orthogonal to the main-scanning direction of the carriage 5 (i.e., the sub-scanning direction or the sheet conveyance direction as indicated by an arrow B).

Further, in a region on one end side of the main-scanning region, a maintenance and restoration mechanism 8 that maintains and restores the recording head 21 is arranged. Moreover, outside a carriage moving region in the main-scanning direction or in a region on the other end side in the main-scanning region, a main cartridge 9 accommodating respective colors of ink to be supplied to the sub-tanks is detachably attached to the recording apparatus main body 1.

Further, a roll sheet (hereinafter referred to as a "sheet") 10 is installed in a sheet feeding unit 6, but a roll sheet different in size in its width direction can also be installed. The sheet 10 conveyed by the sheet feeding unit 6 is conveyed to the recording region by a conveyance unit (not shown) from the rear side to the front side of the apparatus. Then, when the carriage 5 is moved in the main-scanning direction and the recording head 21 is driven in accordance with image information to eject liquid droplets while intermittently feeding the sheet 10, a desired image is formed on the sheet 10. The sheet 10 on which the image is formed is cut into a prescribed length and ejected to a sheet catching tray (not shown) arranged on the front side of the apparatus.

Figure 2:
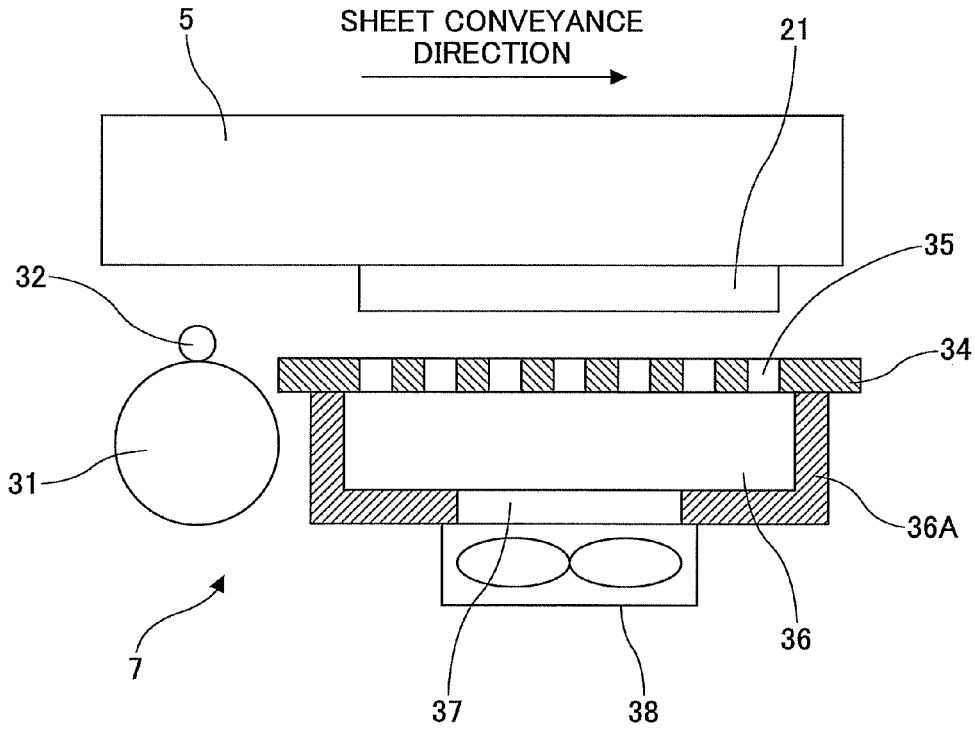
FIG. 2 is a view for schematically explaining a substantial part according to a first embodiment of the present invention.
Figure 3:
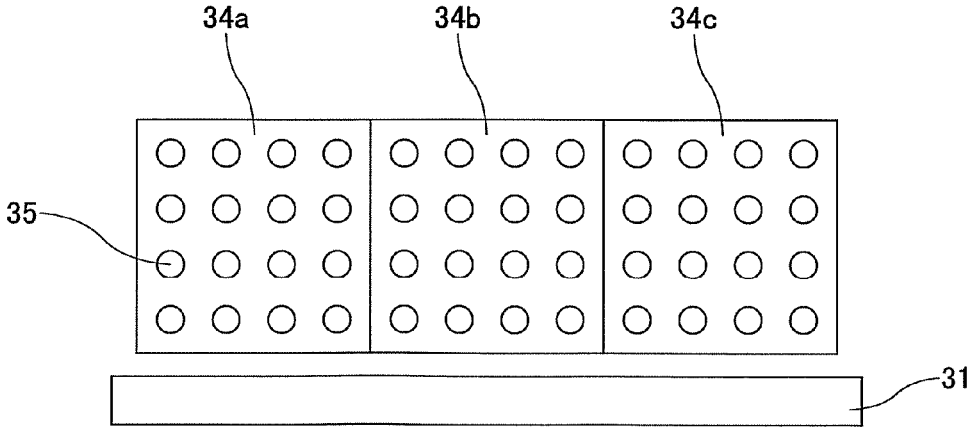
FIG. 3 is a plan view of a suction conveyance unit according to the first embodiment of the present invention.
Figure 4:
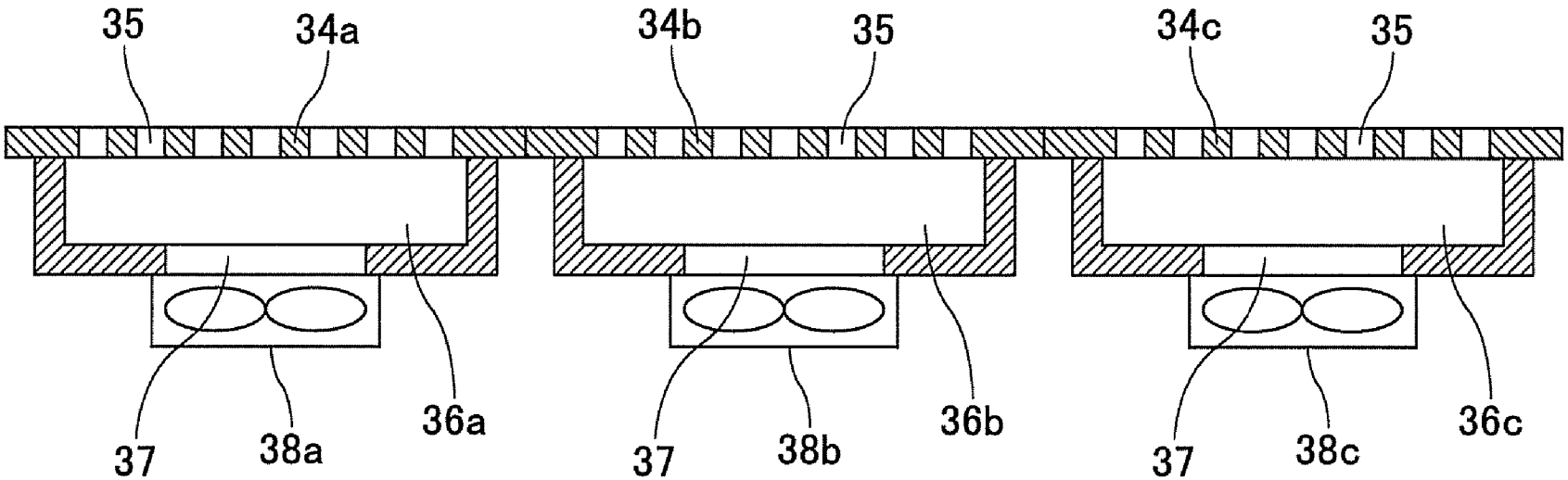
FIG. 4 is a view for explaining the cross section of the suction conveyance unit in a sheet-width direction according to the first embodiment of the present invention.

Referring next to FIGS. 2 through 4, a description is made of a first embodiment of the present invention relating to the ink jet recording apparatus. Note that FIG. 2 is a view for schematically explaining a substantial part according to the first embodiment, FIG. 3 is a plan view of a suction conveyance unit, and FIG. 4 is a view for explaining the cross section of the suction conveyance unit in the sheet-width direction.

As described above, the carriage 5 is moved to scan in the direction orthogonal to the sheet conveyance direction. Further, the carriage 5 has the recording head 21 composed of the liquid ejection head that ejects liquid droplets, the encoder sensor 22 that detects a position in the main-scanning direction of the carriage 5, and the sheet sensor 23 serving as a sheet detection unit composed of an optical sensor, etc., that detects the tip end of the sheet 10, both ends thereof, etc.

The suction conveyance unit 7 has a resist roller 31, a resist pressure roller 32, three platen members 34*a* through 34*c*, three air chambers 36*a* through 36*c*, and three suction fans 38*a* through 38*c*. Here, the resist roller 31 and the resist pressure roller 32 convey the sheet 10 conveyed by the sheet feeding unit 6. Further, the three platen members 34*a* through 34*c* are used to guide the sheet 10, arranged in the sheet-width direction, and have plural suction holes 35 formed therein. Hereinafter, the three platen members 34*a* through 34*c* are referred to as a "platen member 34" and denoted by the same reference numeral when they are not distinguished from one another. Note that the same applies to other members. Further, the three air chambers 36*a* through 36*c* are provided at the back surfaces of the platen members 34*a* through 34*c* and arranged in the sheet-width direction. The three suction fans 38*a* through 38*c* serve as suction units connected to suction ports 37*a* through 37*c* of the air chambers 36*a* through 36*c*, respectively. Note that air chambers 36 are formed of an air-chamber forming member 36A.

In the suction conveyance unit 7, the resist roller 31 and the resist pressure roller 32 convey the sheet 10 onto the platen members 34, which have the plural suction holes 35 and are placed above the air chambers 36, with a predetermined timing, and the suction fans 38 arranged below the air chambers 36 generate a negative pressure in the air chambers 36. Thus, a suction force is applied to the sheet 10 through the suction holes 35 of the platen members 34, whereby the sheet 10 are closely attached to the platen members 34 and maintains its flatness. Then, as described above, the suction conveyance unit 7 intermittently conveys the sheet 10 every time a one-line image is formed by the liquid droplets ejected from the recording head 21 along with the movement of the carriage 5 in the main-scanning direction.

Specifically, the width of the one platen member 34 of the suction conveyance unit 7 is 310 mm, and the length thereof in the conveyance direction is about 120 mm. With the arrangement of the three platen members 34 in the sheet-width direction, the suction conveyance unit 7 can correspond to the sheet 10 having a width of up to 914 mm. Further, the three platen members 34 and the three air chambers 36 provided in the platen members 34 are formed of the same member so as to reduce a manufacturing cost.

Further, the suction fans 38 separately connected to the air chambers 36 can be driven by PWM control, and separate PWM signals can be input to the respective suction fans 38. Therefore, the operations of the suction fans 38 can be separately controlled.

Figure 5:
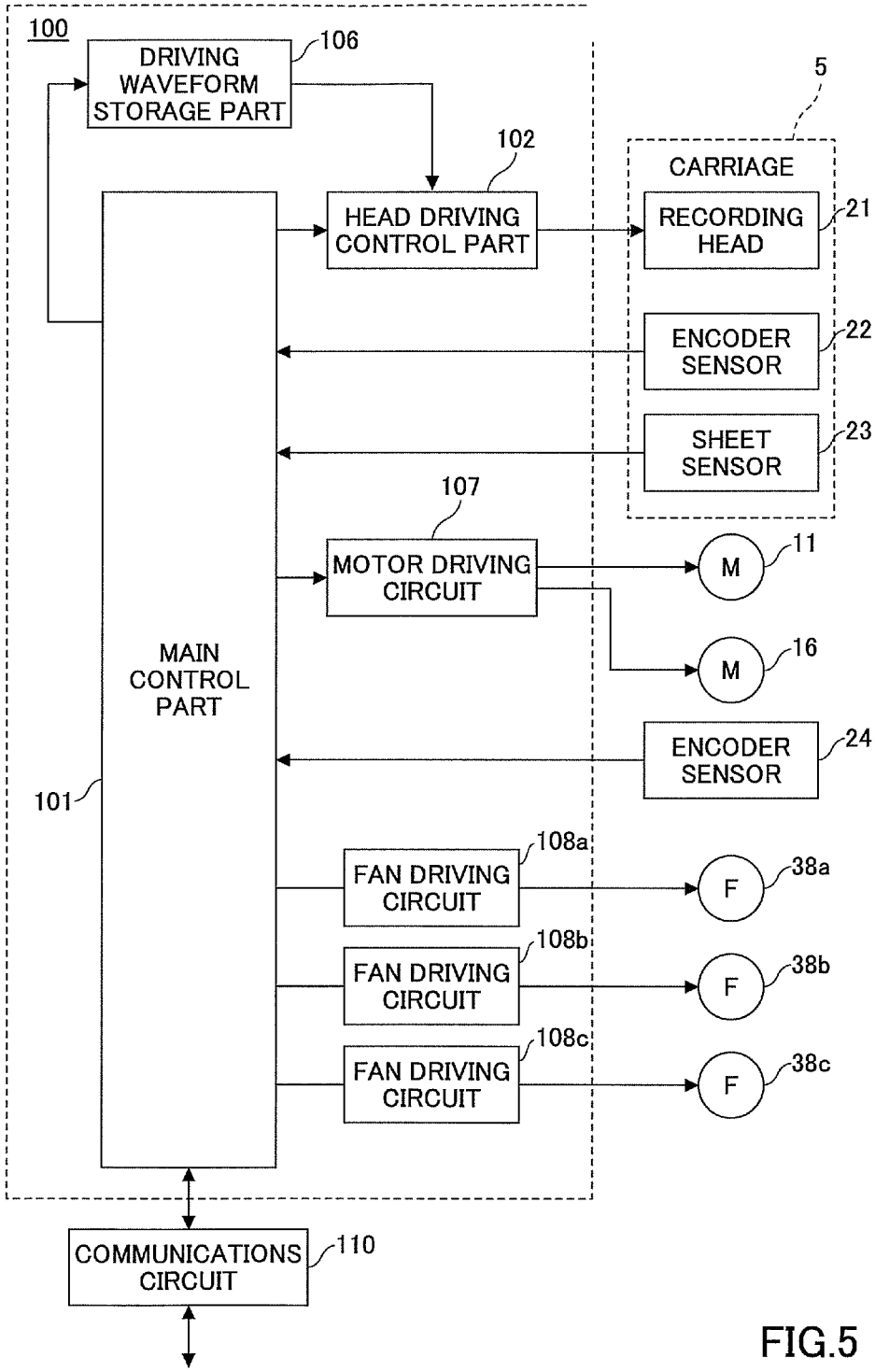
FIG. 5 is a block diagram showing the brief overview of a part relating to sheet conveyance control according to the first embodiment of the present invention.

Referring next to a block diagram shown in FIG. 5, a description is made of the brief overview of a part relating to sheet conveyance control according to this embodiment.

A control unit 100 has a main control part 101, a head driving control part 102, a driving waveform storage part 106, a motor driving circuit 107, fan driving circuits 108*a* through 108*c*, a communications circuit, and the like. Here, the main control part 101 includes a micro computer that is composed of a CPU, a ROM, a RAM, an I/F, and the like, and serves as a unit that controls the driving of the suction fans according to the present invention so as to play a role in controlling the entire recording apparatus. The head driving control part 102 controls the driving of the recording head 21. The driving waveform storage part 106 stores driving waveform data to be applied from the head driving control part 102 to the recording head 21. The motor driving circuit 107 drives a sheet feeding motor 16 that drives the driving motor 11 and the resist roller (conveyance roller) 31 for conveying the sheet 10. The fan driving circuits 108*a* through 108*c* drive the suction fans 38*a* through 38*c*, respectively. The communications circuit 110 performs communications with outside.

Further, the main control part 101 receives a reading signal from the encoder sensor 22 of the carriage 5, a detection signal from the sheet sensor 23, a reading signal from an encoder sensor 24 constituting a rotary encoder that detects the rotational amount of the conveyance roller 31, and the like.

Through the communications circuit 110, the main control part 101 receives print data, etc., from a host such as an information processing apparatus like a personal computer, an image reading apparatus like an image scanner, an image pickup apparatus like a digital camera using a cable or a network. Inside the main control part 101, the RAM is used as a buffer, a work memory, etc., and stores various data. Further, the ROM stores various control routines, font data, graphic functions, procedures, etc., executed by the CPU.

The head driving control part 102 includes a driving signal generation circuit that A/D-converts the driving waveform data stored in the driving waveform storage part 106 to generate driving waveforms for driving the actuator unit of the recording head 21. Then, the head driving control part 102 transmits print data developed into dot pattern data (bit map data), generated driving waveforms, etc., to a head driver (driving IC) (not shown) provided on the side of the carriage 5 that drives the recording head 21.

The main control part 101 detects a position in the main-scanning direction of the carriage 5 based on a reading signal from the encoder sensor 22 to control the moving stop position of the carriage 5. In addition, the main control part 101 detects the tip end and the right and left ends of the sheet 10 based on a detection signal from the sheet sensor 23 of the carriage 5, and also detects the conveyance amount of the sheet 10 based on the reading signal from the encoder sensor 24 using the detected position of the tip end of the sheet 10 as a reference.

Moreover, based on the size of the sheet 10 and the conveyance amount thereof transmitted from an operations panel and an external apparatus (not shown), the main control part 101 controls the driving of the suction fans 38*a* through 38*c* by PWM control through the fan driving circuits 108*a* through 108*c*.

Figure 6:
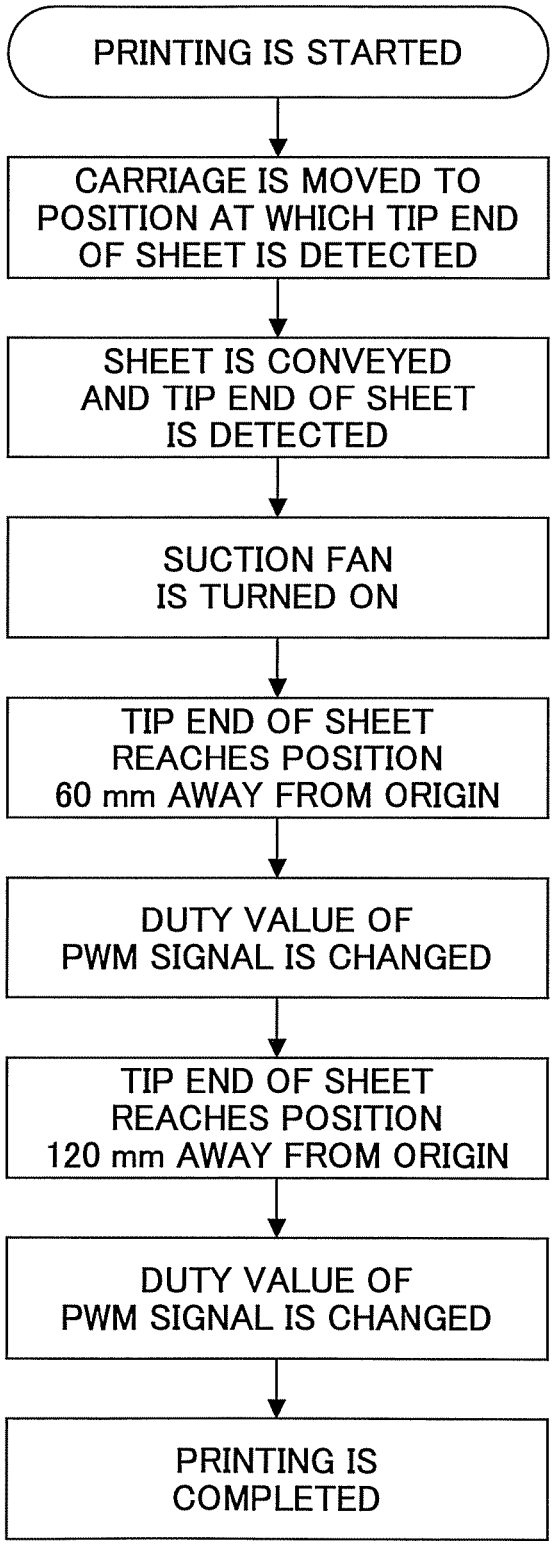
FIG. 6 is a flowchart for explaining the sheet conveyance control according to the first embodiment of the present invention.
Figure 7A:
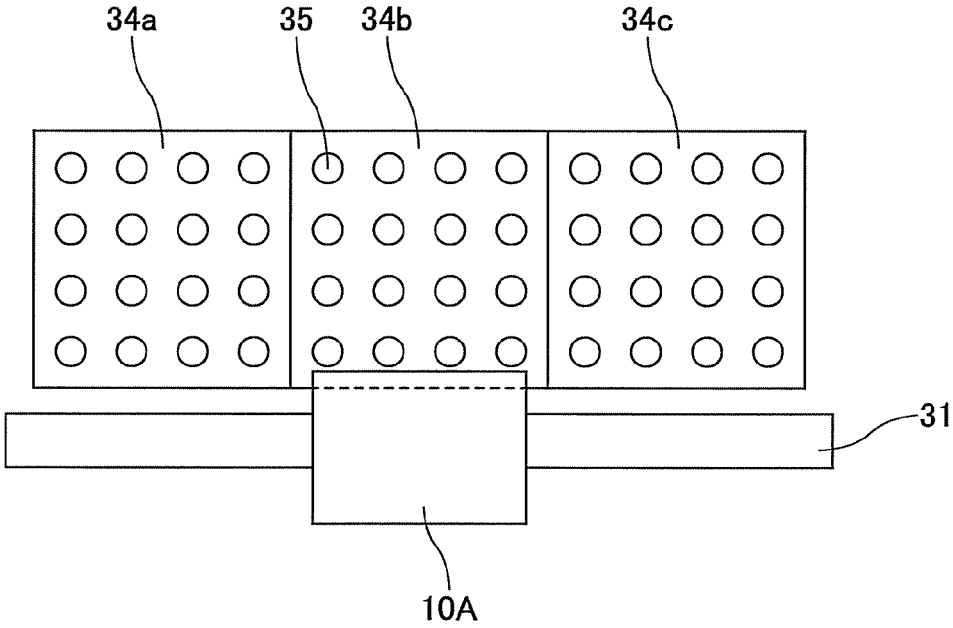
FIGS. 7A through 7C are plan views of the suction conveyance unit for explaining the conveyance operation of a sheet according to the first embodiment of the present invention.
Figure 7B:
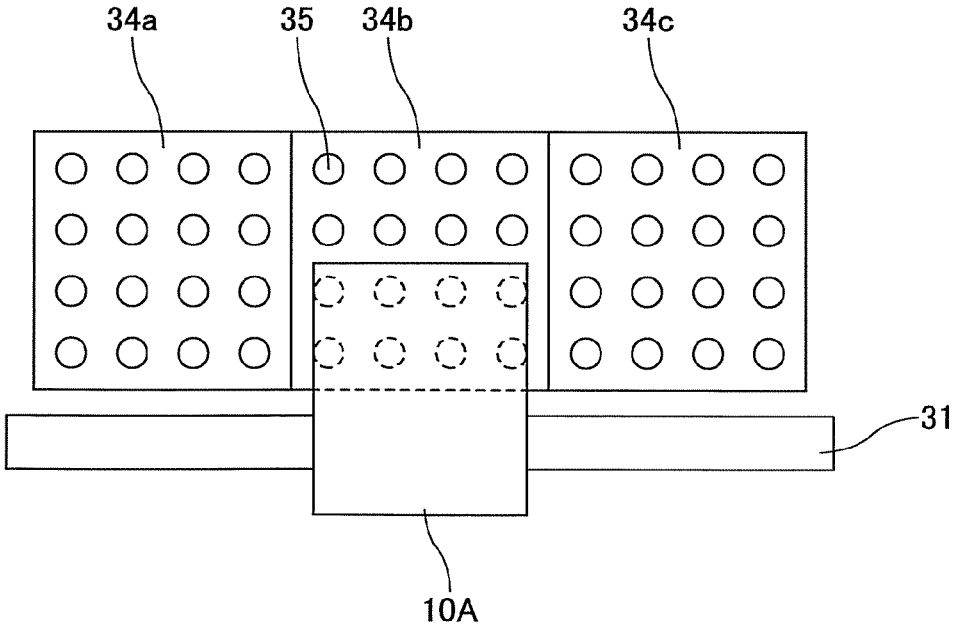
Figure 7C:
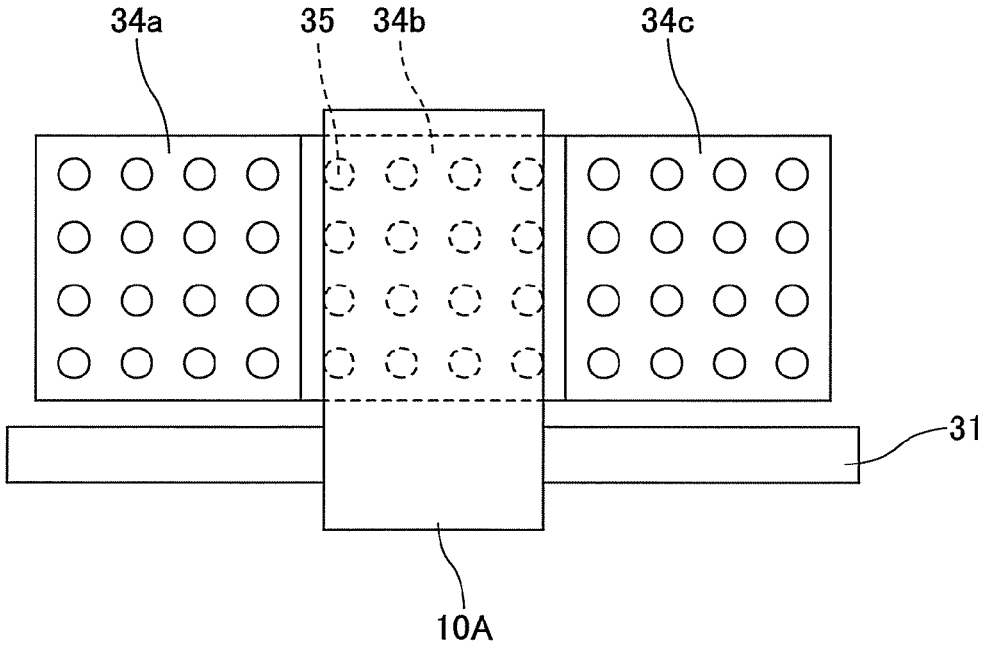
Figure 8:
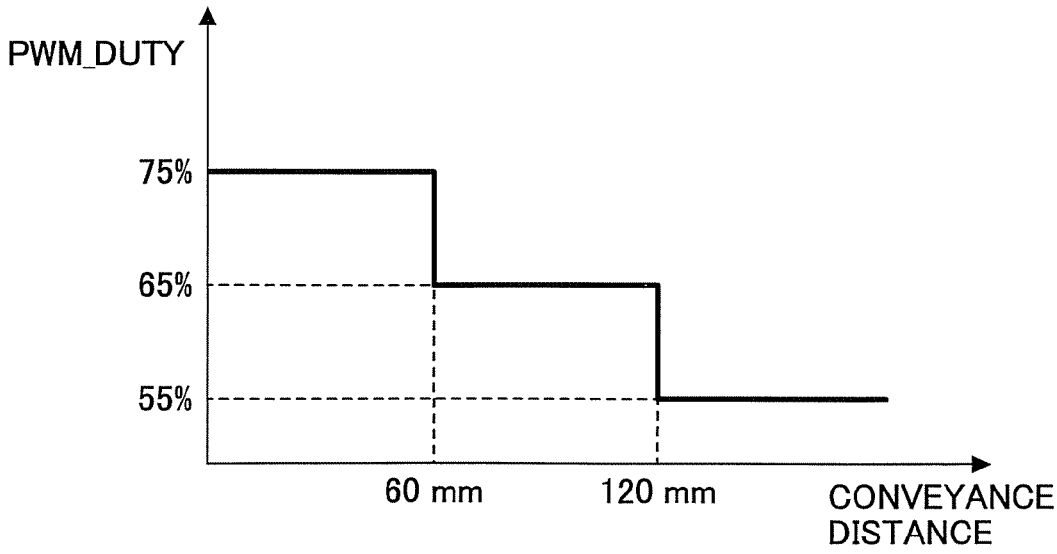
FIG. 8 is a graph for explaining the duty value of a PWM signal relative to a suction fan according to the first embodiment of the present invention.

Referring next to FIGS. 6 through 8, a description is made of an example of the sheet conveyance control according to this embodiment. Note that FIG. 6 is a flowchart for explaining the sheet conveyance control, FIGS. 7A through 7C are plan views of the suction conveyance unit 7 for explaining the conveyance operation of the sheet, and FIG. 8 is a graph for explaining the duty value of a PWM signal relative to the suction fan.

Here, the center in the sheet-width direction of the sheet 10 is set as a reference, and the center in the sheet-width direction of the platen members 34 (the center position in the sheet-width direction of the platen members 34) is set as a reference for conveying the sheet 10.

First, a description is made of an operation when the sheet 10 having a width of 297 mm (hereinafter referred to as a "sheet 10A") is printed.

Upon receipt of a print request, the carriage 5 is moved to a tip-end detection position so that the tip end of the sheet 10A fed from the sheet feeding unit 6 is detected. With the driving of the resist roller 31, the sheet 10A is conveyed until the sheet sensor 23 on the carriage 5 detects the tip end of the sheet 10A. Then, the sheet 10A is stopped, and the operation of only the suction fan 38*b* is started with the duty value of the PWM signal set to 75% (FIG. 8).

When passing through the platen member 34*b*, the sheet 10A having a width of 297 mm covers most of the width (310 mm) of the platen member 34*b*. Therefore, as shown in FIG. 7C, most of the suction holes 35 in the width direction of the platen member 34*b* are sealed by the sheet 10A. Thus, even with the suction fan whose maximum static pressure is small, a sufficient amount of suction force can be applied to the sheet 10A by a negative pressure in the air chamber 36*b*.

On this occasion, when the sheet 10A having a width of 297 mm passes over the suction holes 35 of the platen member 34*b*, the suction holes 35 of the platen members 34*a* and 34*c* remain opened at all times as shown in FIGS. 7A through 7C. Therefore, the duty values of the PWM signals of the suction fans 38*a* and 38*c* are set to be 0%, and thus the suction fans 38*a* and 38*c* are not operated (i.e., the suction fans 38*a* and 38*c* are stopped).

Then, the conveyance distance (conveyance amount) of the sheet 10A is calculated from a reading pulse number from the encoder sensor 24 with the detected position of the tip end of the sheet 10A as an origin, and the duty value of the PWM signal of the suction fan 38 is changed in accordance with the conveyance distance of the sheet 10A.

In other words, when the tip end of the sheet 10A reaches the position 60 mm away from the origin (the position shown in FIG. 7B), nearly half of the suction holes 35 in the conveyance direction of the platen member 34*b* are covered by the sheet 10A, which in turn reduces the number of the openings of the suction holes 35 by about one-half. Therefore, a negative pressure in the air chamber 36*b* can be appropriately maintained even if the duty value of the PWM signal relative to the suction fan 38*b* is reduced, and thus a sufficient amount of suction force can be applied to the sheet 10A. For example, the suction fan 38*b* which has been driven with a duty value of 75% is driven with a duty value of 65%.

When the sheet 10A is further conveyed and the tip end of the sheet 10A reaches the position 120 mm away from the origin (the position shown in FIG. 7C), all the suction holes 3 in the conveyance direction of the platen member 34*b* are covered by the sheet 10A and thus nearly all the suction holes 35 are sealed thereby. Therefore, the duty value of the PWM signal is further reduced to 55%, so as to drive the suction fan 38*b*.

As described above, the control is made such that the duty value of the PWM signal relative to the suction fan 38*b* is changed (reduced) in accordance with the conveyance distance of the sheet 10A. Therefore, the operation of the suction fan 38*b* can be optimized. Thus, a large suction force is applied to the sheet 10A, whereby degradation in conveyance accuracy, the buckling of the sheet 10A onto the platen member 38*b* without being conveyed due to the suction force exceeding the strength of the sheet 10A can be prevented. As a result, a reduction in the consumption power and the noise of the suction fan can be achieved.

Note that the operation of the suction fan 38*b* is changed twice in accordance with the conveyance distance of the sheet 10A. The number of changing the operation of the suction fan 38*b* is not limited to twice, but may be one or three or more times. Alternatively, even when the number is changed linearly in accordance with the conveyance distance rather than being changed in a stepwise manner, the same effects can be obtained.

Figure 9A:
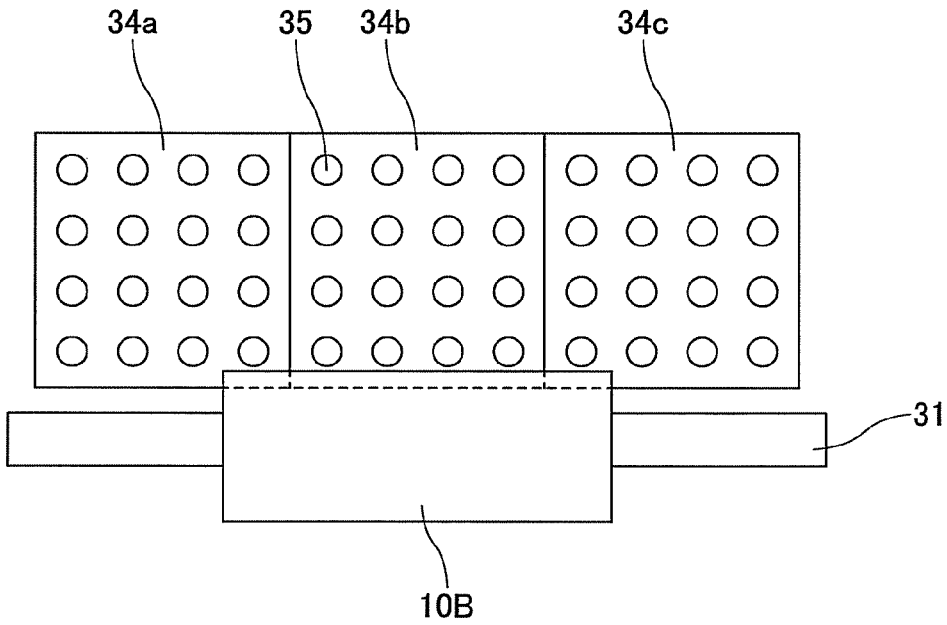
FIGS. 9A through 9C are plan views of the suction conveyance unit for explaining the conveyance operation of a sheet of another size according to the first embodiment of the present invention.
Figure 9B:
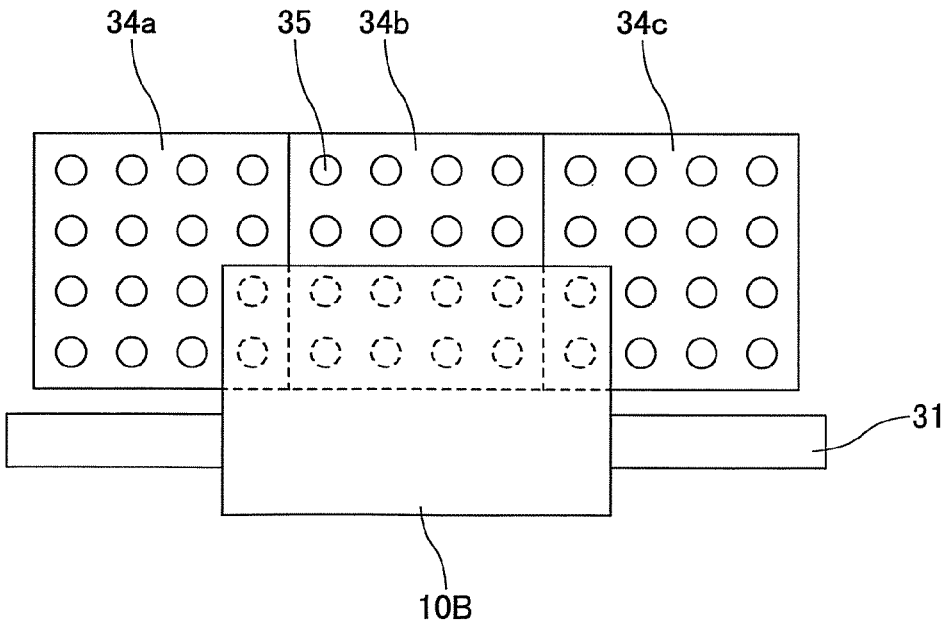
Figure 9C:
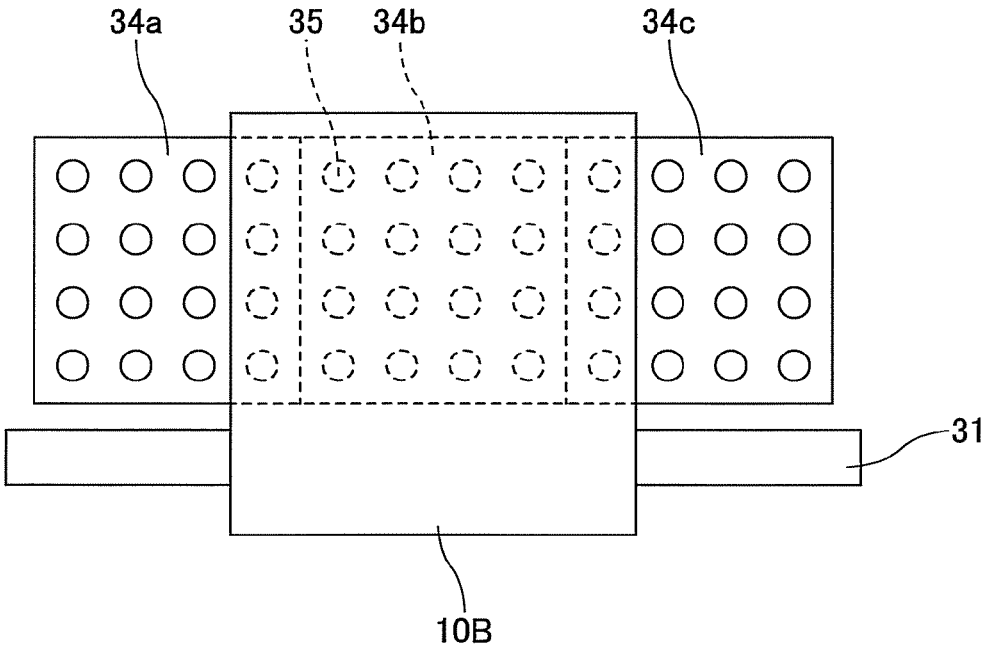
Figure 10:
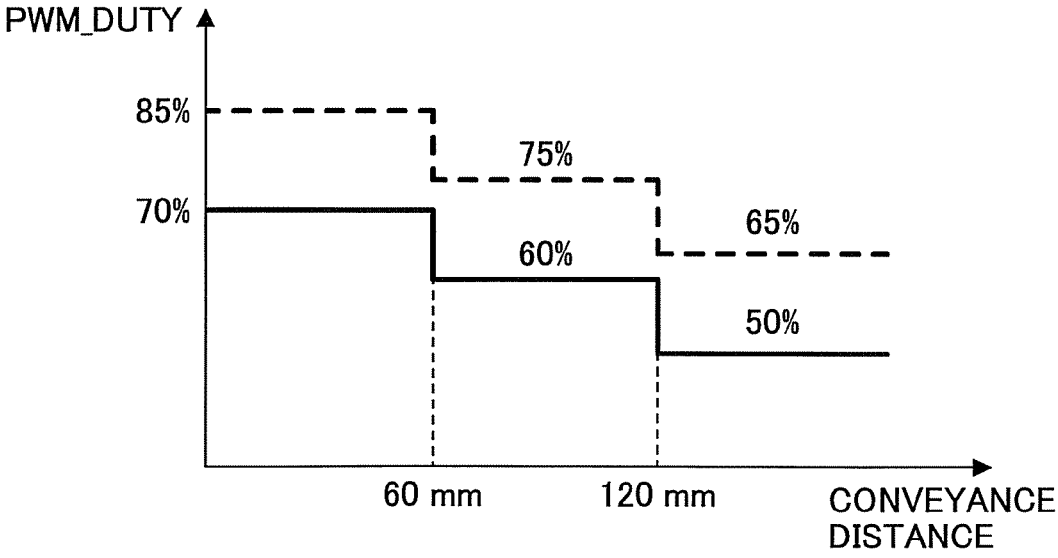
FIG. 10 is a graph for explaining changes in the duty values of the suction fans according to the first embodiment of the present invention.

Referring next to FIGS. 9A through 9C and 10, a description is made of an operation when a sheet (e.g., a sheet having a width of 420 mm, hereinafter referred to as a "sheet 10B") larger than the sheet 10A is conveyed. Note that FIGS. 9A through 9C are plan views of the suction conveyance unit for explaining the operation thereof, and FIG. 10 is a graph for explaining changes in the duty values of the suction fans wherein a solid line represents the change in the duty value of suction fan 38*b* and a dashed line represents the change in the values of the suction fans 38*a* and 39*c*.

The sheet 10B to be conveyed has a width of 420 mm. Therefore, as shown in FIGS. 9B and 9C, all the suction holes 35 in the width direction of the platen 34*b* are sealed by the sheet 10B, while some of the suction holes 35 in the width direction of the platen members 34*a* and 34*c* are sealed by the sheet 10B. When the suction fan 38*b* is driven after the detection of the tip end of the sheet 10B as shown in FIG. 9A, the duty value of the PWM signal of the suction fan 38*b* becomes smaller compared with the case where the sheet 10A having a width of 297 mm is used as shown in FIG. 10 because there are no openings of the suction holes. Thus, the driving of the suction fan 38*b* is started with a duty value of 70%. Further, since the opening areas of the platen members 34*a* and 34*c* are larger than that of the platen member 34*b* when the sheet 10A having a width of 297 mm is used, the driving of the suction fans 38*a* and 38*c* is started with a duty value of 85%.

As described above, the duty value of the PWM signal of the suction fan 38 is set to be larger as the opening area of the suction holes 35 of the platen member 34 increases, while the duty value of the PWM signal thereof is set to be smaller as the opening area decreases. Accordingly, a negative pressure in the air chamber connected to the platen member having a large opening area can be maintained at a required level, which in turn prevents the floating of sheets in various sizes.

Then, as in the case of the sheet 10A having a width of 297 mm, the change in the duty values of the PWM signals is controlled in accordance with the conveyance distance. In other words, when the tip end of the sheet 10B reaches the position 60 mm away from the origin (the position shown in FIG. 9B), the duty value of the PWM signal of the suction fan 38*b* is changed from 70% to 60% and those of the PWM signals of the suction fans 38*a* and 38*c* are changed from 85% to 75%. When the tip end of the sheet 10B reaches the position 120 mm away from the origin (the position shown in FIG. 9C), the duty value of the PWM signal of the suction fan 38*b* is changed from 60% to 50% and those of the PWM signals of the suction fans 38*a* and 38*c* are changed from 75% to 65%

Note that the control in the operations of the suction fans is based on, but not limited to, the duty values of the PWM signals. Alternatively, even when the control in the operations of the suction fans is based on other methods such as changing input voltage, the same effects can be obtained.

Figure 11A:
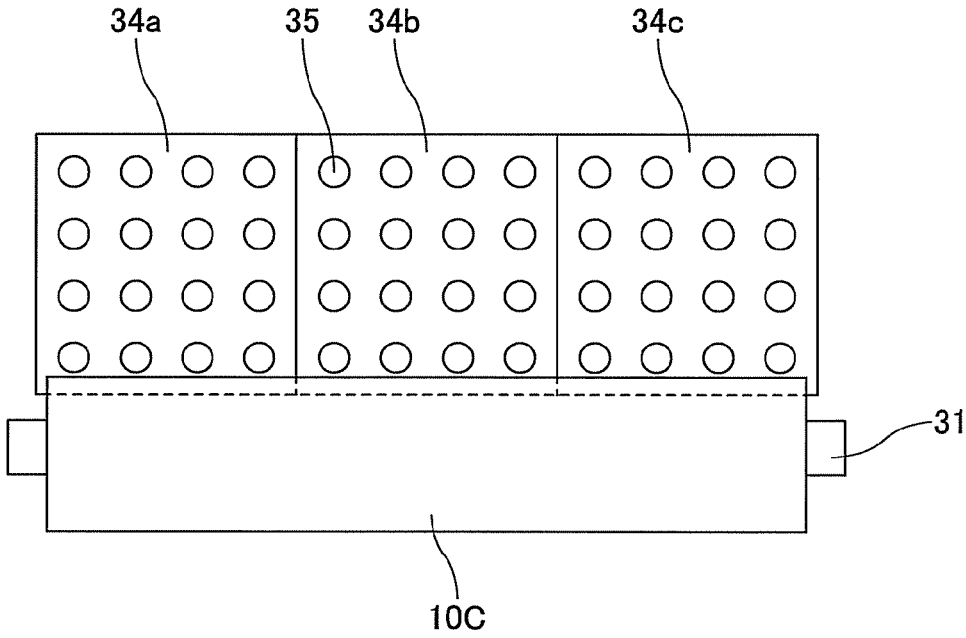
FIGS. 11A through 11C are plan views of the suction conveyance unit for explaining the conveyance operation of a sheet of another size according to the first embodiment of the present invention.
Figure 11B:
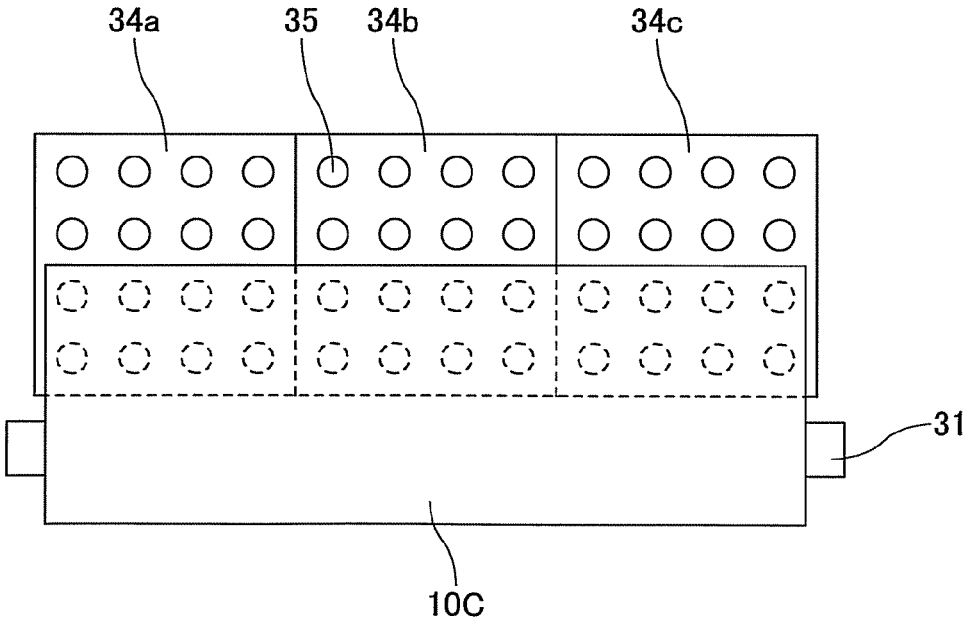
Figure 11C:
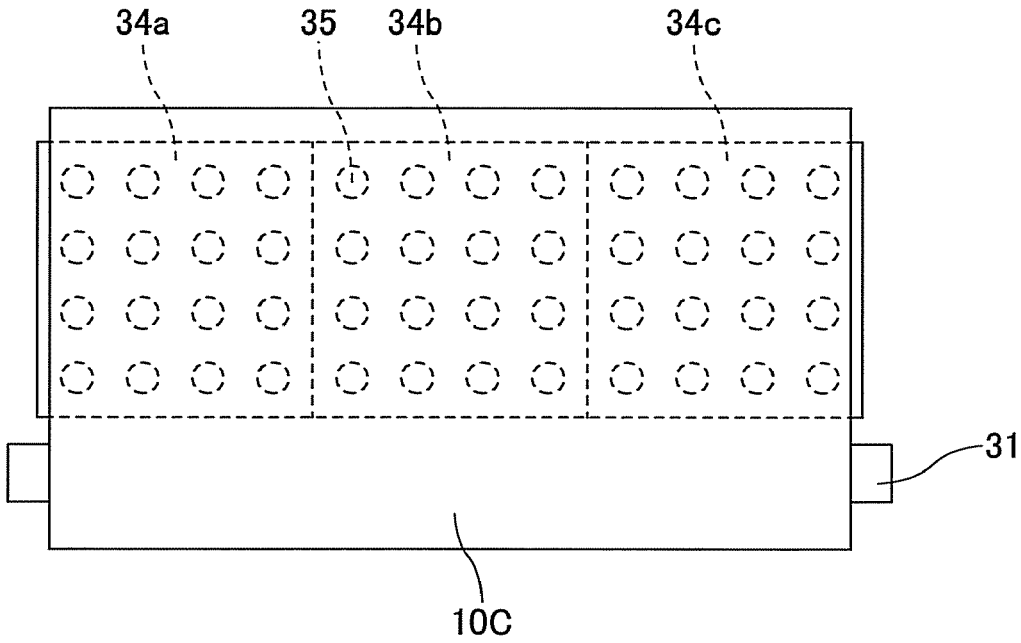

Referring next to FIGS. 11A through 11C, a description is made of an operation when a sheet (e.g., a sheet having a width of 914 mm, hereinafter referred to as a "sheet 10C") larger than the sheet 10B is conveyed. Note that FIGS. 11A through 11C are plan views of the suction conveyance unit for explaining the operation thereof.

When the sheet 10C having the maximum width passes through the suction conveyance unit, all the suction holes 35 in the width direction of the three platen members 34*a* through 34*c* are sealed by the sheet 10C. Therefore, control is made such that the duty values of the PWM signals of the three suction fans 38*a* through 38*c* are set to be the same as the duty value of the PWM signal of the suction fan 38*b* when the sheet 10B having a width of 420 mm is conveyed.

In other words, after the detection of the tip end of the sheet 10C (FIG. 11A), the driving of the suction fans 38*a* through 38*c* is started with the duty values of the PWM signals of the suction fans 38*a* through 38*c* set to 70%. When the tip end of the sheet 10C reaches the position 60 mm away from the origin (the position shown in FIG. 11B), the duty values of the PWM signals of the suction fans 38*a* through 38*c* are changed from 70% to 60%. Then, when the tip end of the sheet 10C reaches the position 120 mm away from the origin (the position shown in FIG. 11C), the duty values of the PWM signals of the suction fans 38*a* through 38*c* are changed from 60% to 50%.

As described above, the duty values of the PWM signals of the suction fans are changed in accordance with the sheet width (sheet size) and the opening areas of the suction holes changed in accordance with the conveyance distance of the sheet. Therefore, even with the sheets in various sizes (from small sizes to large sizes), degradation in conveyance accuracy due to an increase in a suction force, conveyance failure due to the buckling of the sheets, and the floating of the sheets and contact with the head due to an insufficient suction force can be prevented at the same time. As a result, the conveyance can be performed safely. In addition, only the required suction fan is operated so as to correspond to the size of the sheet. As a result, a reduction in the consumption power and the noise of the suction fan and the downsizing of the apparatus can be achieved.

That is, according to the configuration of the first embodiment of the present invention, at least the two or more air chambers are arranged in the direction crossing the conveyance direction of the medium to be recorded. In addition, one of the plural air chambers is connected to the one suction unit, and the other one or two or more air chambers is connected to the at least one suction unit. Therefore, an appropriate suction force corresponding to the size of the medium to be recorded can be generated without the use of a complicated mechanism such as an opening/closing unit and an opening/closing valve, and thus image degradation due to the floating of the medium to be recorded and damage on the medium to be recorded due to the contact with the head can be prevented.

In this case, since the suction units are separately connected to the plural air chambers, negative pressures in the respective air chambers can be easily controlled.

Figure 12:
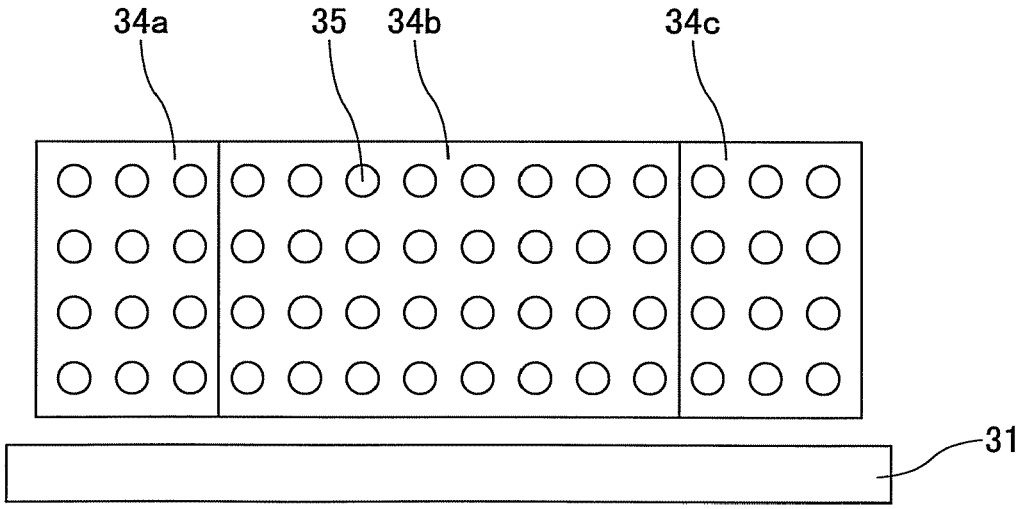
FIG. 12 is a plan view of the suction conveyance unit according to a second embodiment of the present invention.
Figure 13:
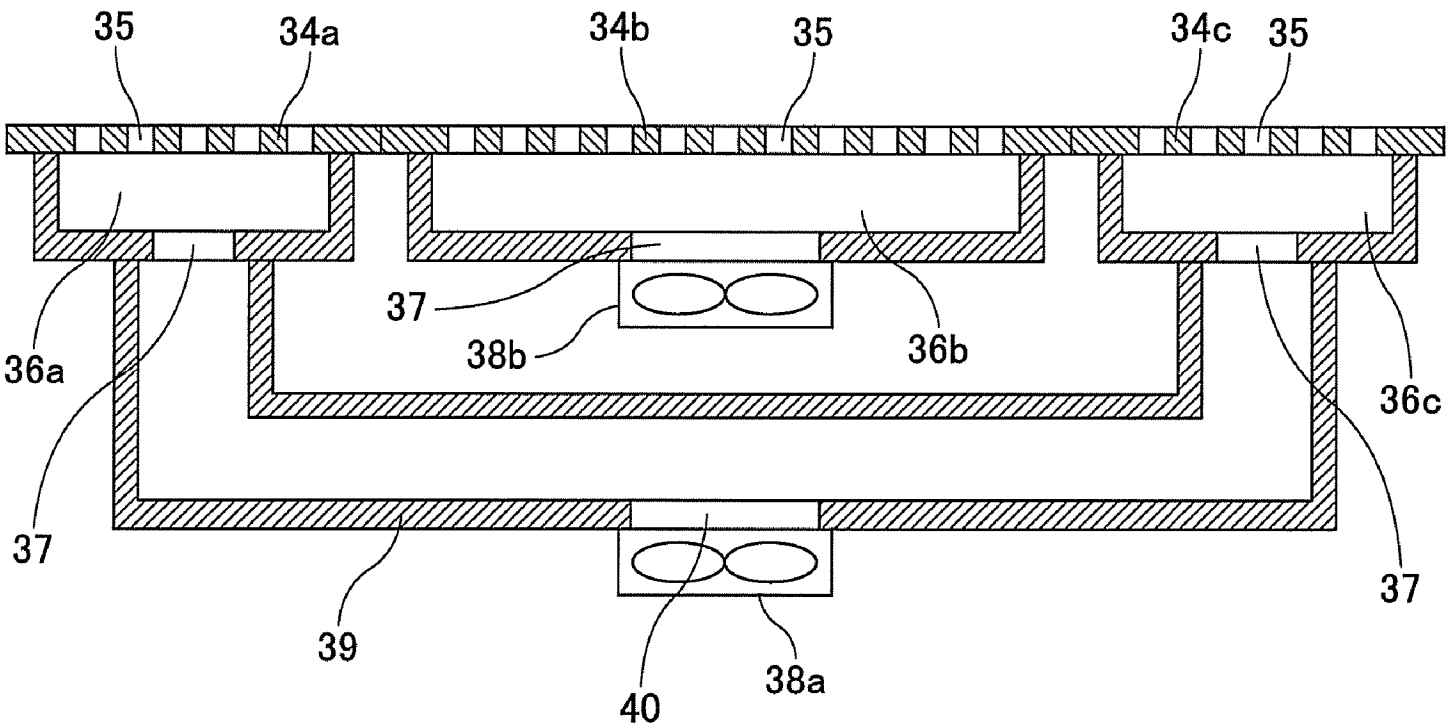
FIG. 13 is a view for explaining the cross section of the suction conveyance unit according to the second embodiment of the present invention.

Referring next to FIGS. 12 and 13, a description is made of a second embodiment of the present invention. Note that FIG. 12 is a plan view of the suction conveyance unit according to the second embodiment, and FIG. 13 is a view for explaining the cross section of the suction conveyance unit according to the second embodiment.

In this embodiment, the three air chambers 36*a* through 36*c* and the platen members 34*a* through 34*c* are arranged side by side in the sheet-width direction, but the air chamber 36*b* and the platen member 34*b* arranged on the central side are made larger in width than the air chambers 36*a* and 36*c* and the platen members 34*a* and 34*c* arranged on both sides. The air chamber 36*b* on the central side is connected to the one suction fan 38*b*. On the other hand, the suction ports 37 of the air chambers 34*a* and 34*c* on the both sides are connected to a common path 39, and a suction port 40 provided in the common path 39 is connected to the one suction fan 38*a*.

In this case, the center in the width direction of a sheet is set as a reference for conveying the sheet. Thus, since negative pressures in the air chambers 36*a* and 36*b* on the both sides are controlled in the same way, the same effects can be obtained with this configuration. In addition, since the number of the fans used in the suction conveyance unit decreases from three to two, a reduction in the consumption power and the noise of the suction fans can be achieved.

Figure 14:
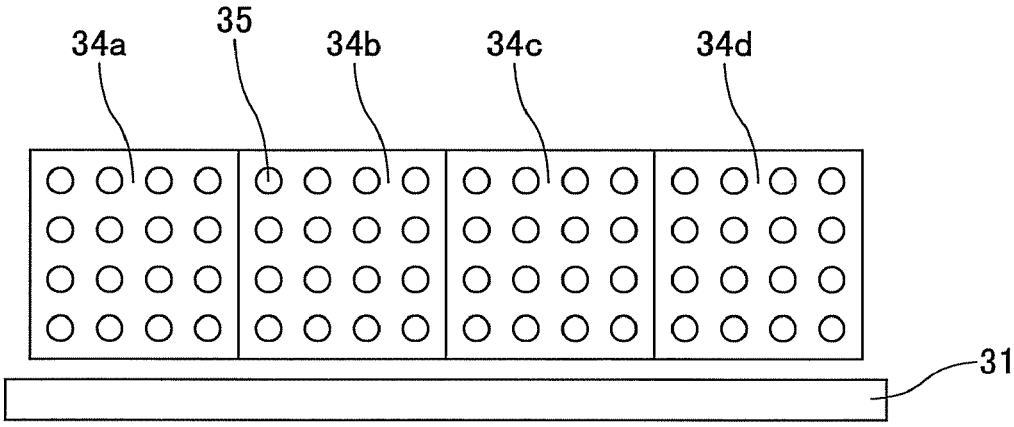
FIG. 14 is a plan view of the suction conveyance unit according to a third embodiment of the present invention.
Figure 15:
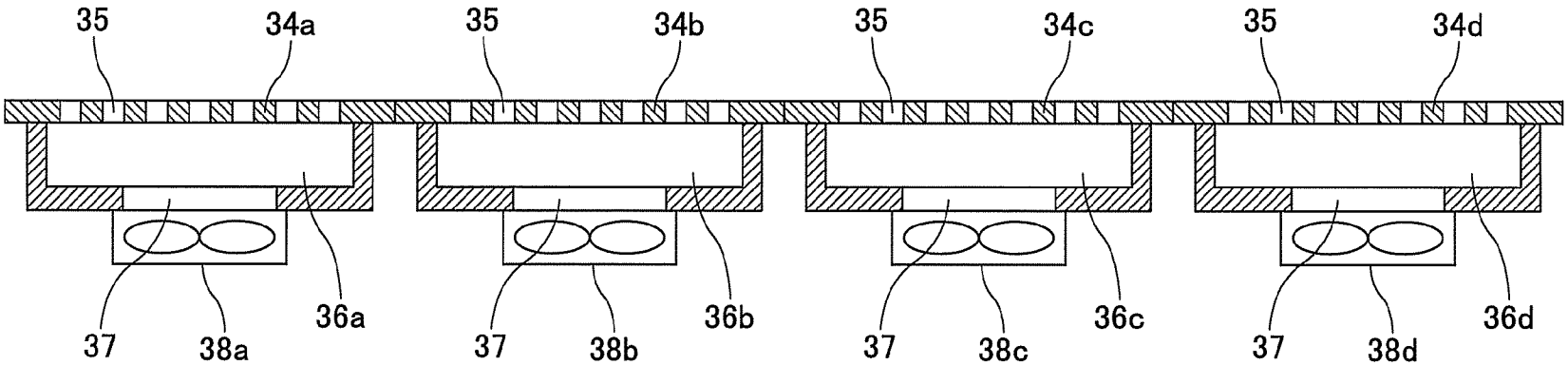
FIG. 15 is a view for explaining the cross section of the suction conveyance unit according to the third embodiment of the present invention.

Referring next to FIGS. 14, 15, 16A through 16C, and 17A through 17C, a description is made of a third embodiment of the present invention. Note that FIG. 14 is a plan view of the suction conveyance unit according to the third embodiment, and FIG. 15 is a view for explaining the cross section of the suction conveyance unit according to the third embodiment.

In this embodiment, the four platen members 34*a* through 34*d*, the air chambers 36*a* through 36*d* corresponding to the platen members 34*a* through 34*d*, respectively, and the suction fans 38*a* through 38*d* connected to the air chambers 36*a* through 36*d*, respectively, are arranged in the sheet-width direction.

Figure 16A:
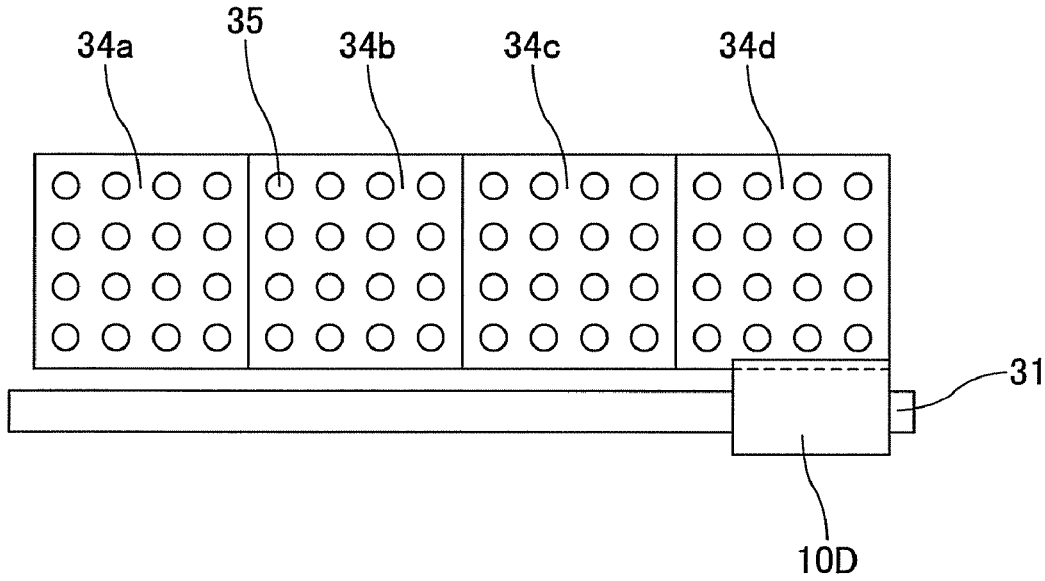
FIGS. 16A through 16C are plan views of the suction conveyance unit for explaining the conveyance operation of a sheet according to the third embodiment of the present invention.
Figure 16B:
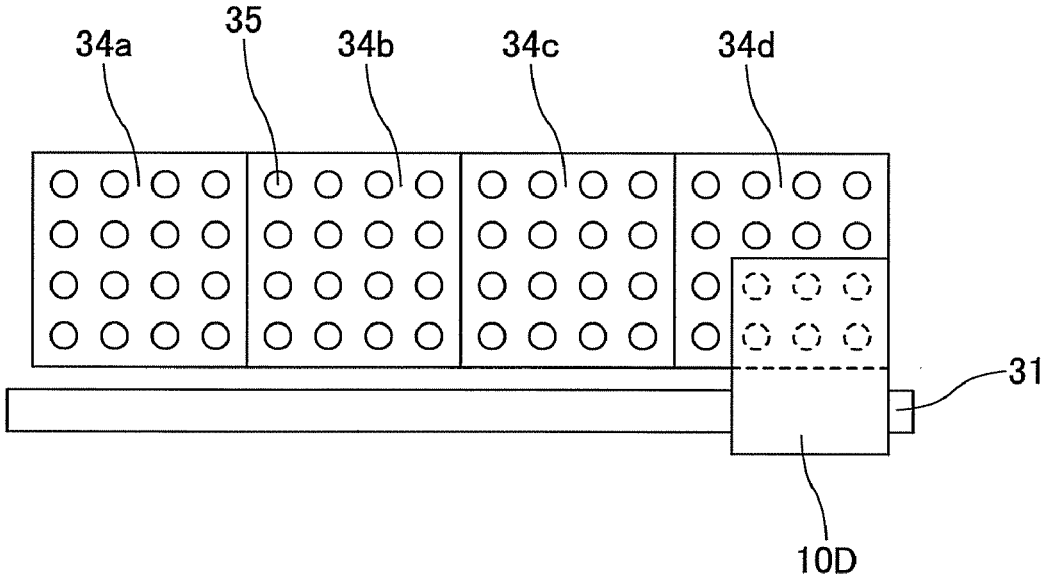
Figure 16C:
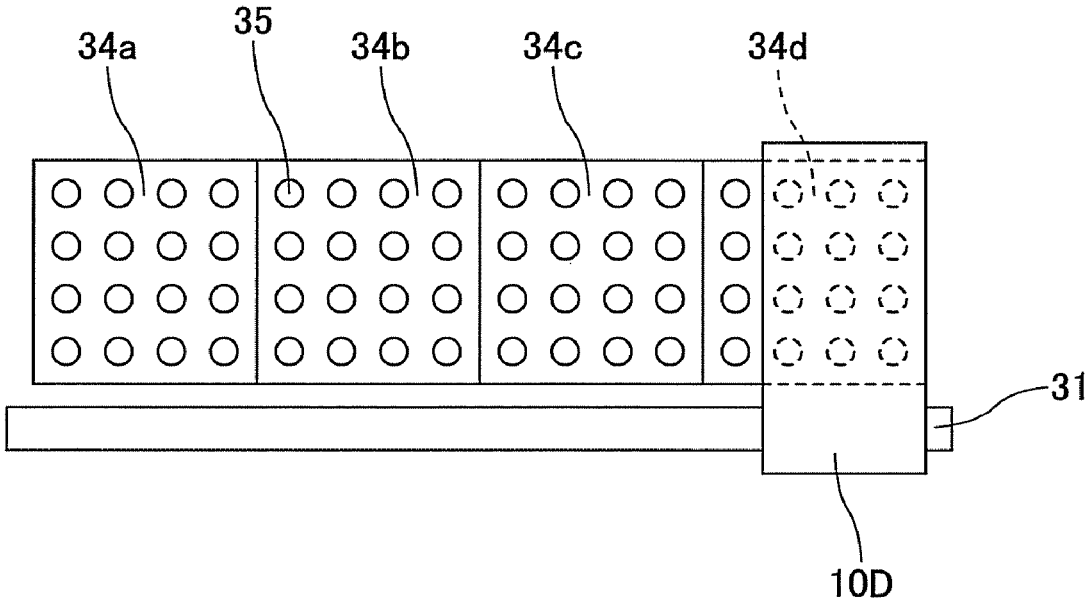

For example, assuming that the width of the one platen member 34 is set to be about 230 mm, the arrangement of the four platen members 34 can correspond to a sheet having a width of 914 mm. Further, assuming that the right end of a sheet and the right end of the platen member are set as references for conveying the sheet, when the sheet 10D having a width of 210 mm passes through the suction conveyance unit, the suction holes 35 of the platen member 34*d* are nearly sealed and the suction holes 35 of the platen members 34*a* through 34*c* remain opened as shown in FIG. 16C. Therefore, with the driving of only the one suction fan 36*d*, a sufficient suction force can be applied even to the small sheet 10D having a width of 210 mm.

As described above, with an increase in the number of the air chambers, the suction conveyance unit can correspond even to a smaller sheet.

Figure 17A:
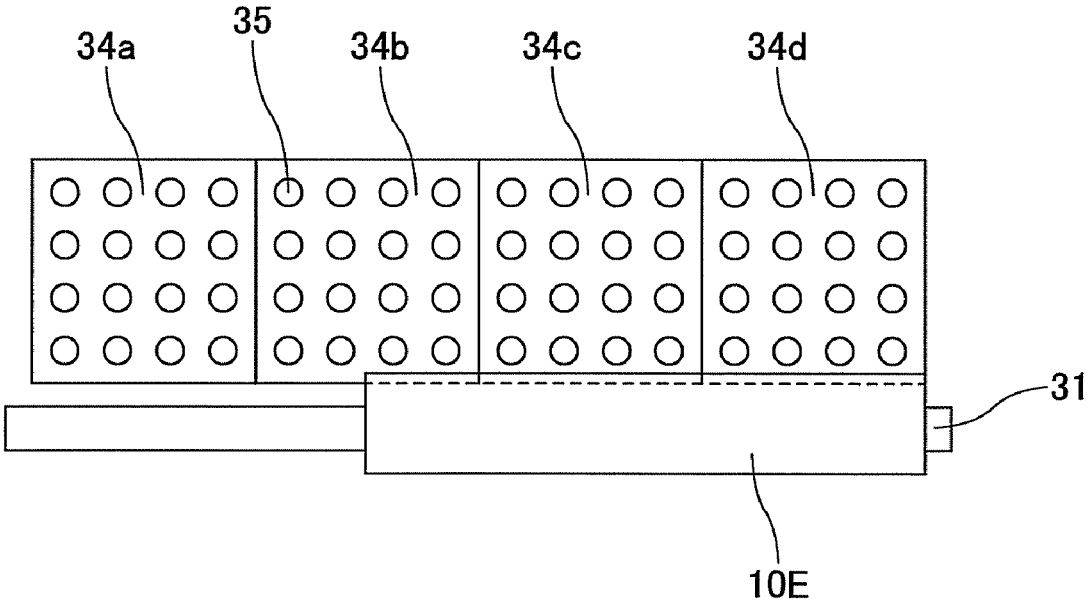
FIGS. 17A through 17C are plan views of the suction conveyance unit for explaining the conveyance operation of a sheet of another size according to the third embodiment of the present invention.
Figure 17B:
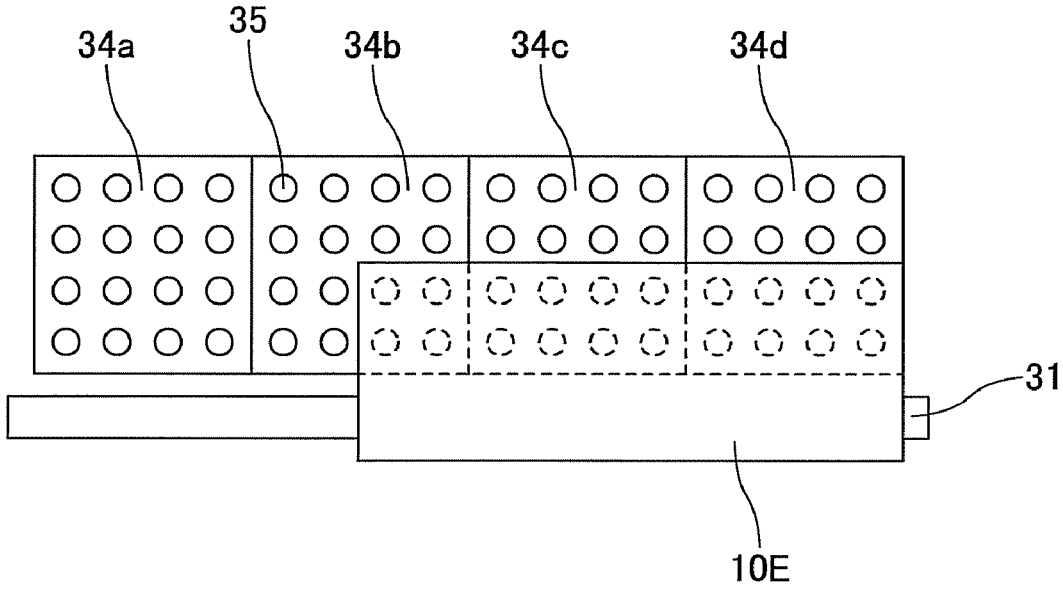
Figure 17C:
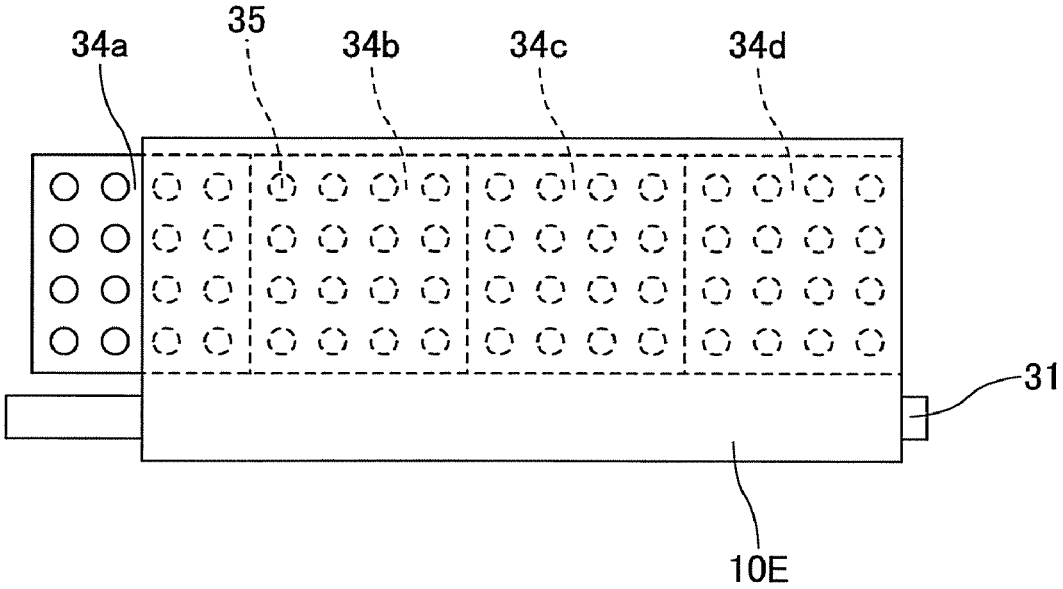

Moreover, in the case of the sheet 10D having a minimum size of 210 mm, the maximum static pressure of the suction fans 36*a* through 36*c* where the suction holes 35 remain opened is set to be 400 Pa, which is higher than the maximum static pressure 300 Pa of the suction fan 38*d*. Thus, with the sheet 10E having a width of 594 mm, all the suction holes 35 in the width direction of the platen member 34*d* are sealed by the sheet 10E (FIG. 17B). Therefore, a sufficient suction force can be applied to the sheet 10E even with the suction fan 34*d* having a low maximum static pressure. Further, since some of the suction holes 35 of the platen member 34*b* are sealed by the sheet 10E, an appropriate suction force can be applied to the sheet 10E through the suction of the suction fan 38*d* having a high maximum static pressure. On the other hand, since all the suction holes 35 of the platen member 34*a* are remain open, the suction fan 38*a* is not operated.

Similarly, in the case of the sheet having a width of 297 mm, all the suction holes 35 of the platen 34*d* are covered by the sheet, and some of the suction holes 35 of the platen member 34*c* remain open. Therefore, with the use of the suction fan 38*c* having a high maximum static pressure, an appropriate suction force can be easily applied as in the case of the sheet having a width of 594 mm.

Figure 18:
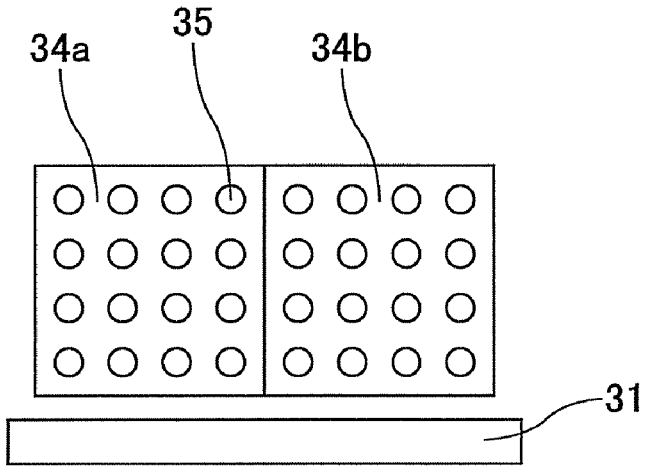
FIG. 18 is a plan view of the suction conveyance unit according to a fourth embodiment of the present invention.
Figure 19:
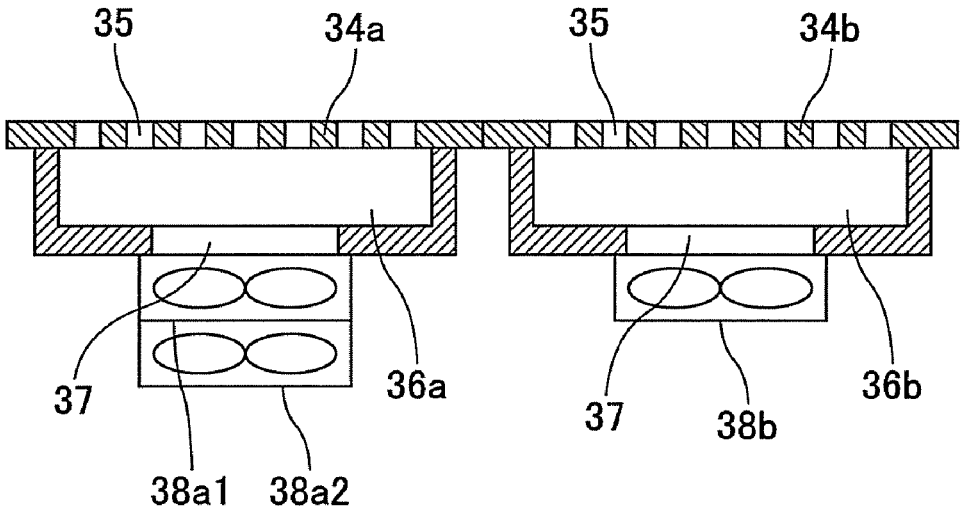
FIG. 19 is a view for explaining the cross section of the suction conveyance unit according to the fourth embodiment of the present invention.

Referring next to FIGS. 18, 19, 20A through 20C, and 21A through 21C, a description is made of a fourth embodiment of the present invention. Note that FIG. 18 is a view for explaining the plan of the suction conveyance unit according to the fourth embodiment, and FIG. 19 is a view for explaining the cross section of the suction conveyance unit according to the fourth embodiment.

In this embodiment, the two platen members 34*a* and 34*b* and the air chambers 36*a* and 36*b* corresponding to the platen members 34*a* and 34*b*, respectively, are arranged in the sheet-width direction. Further, the two suction fans 38*a*1 and 38*a*2 are connected to the air chamber 36*a*, and the one suction fan 38*b* is connected to the air chamber 36*b*.

Such a configuration is particularly suitable for an image forming apparatus that allows a sheet whose maximum size is small, e.g., an A3 sheet, to pass through. The right end of the sheet and the right end of the platen member are set as references for conveying the sheet. When the maximum size of the sheet is A3, the width of the sheet is 297 mm at a maximum. Therefore, the width of the one platen member 34 is set to be about 150 mm. Further, with the series arrangement of the two suction fans 38*a* and 38*b* in the air chamber 36*a* of the platen member 34*a*, a negative pressure in the air chamber 36*a* where the suction holes 35 remain open in most cases can be easily set to an appropriate level.

Figure 20A:
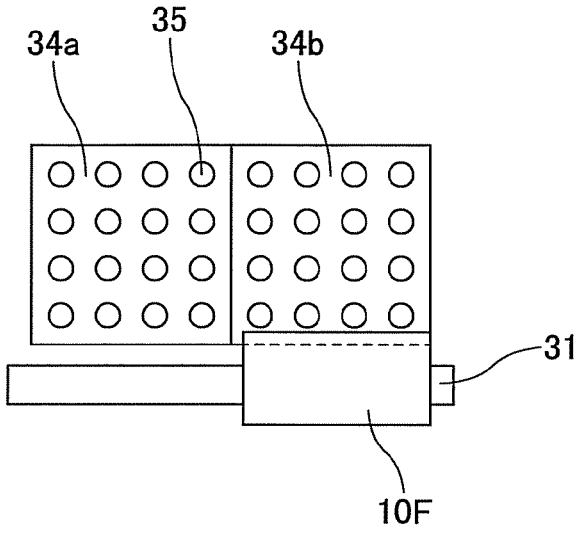
FIGS. 20A through 20C are plan views of the suction conveyance unit for explaining the conveyance operation of a sheet according to the fourth embodiment of the present invention.
Figure 20B:
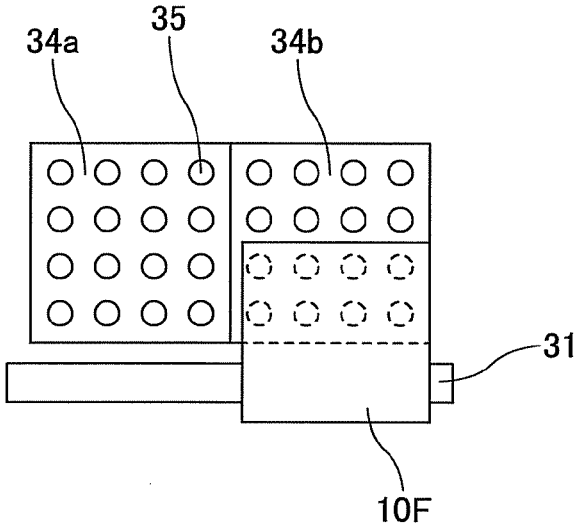
Figure 20C:
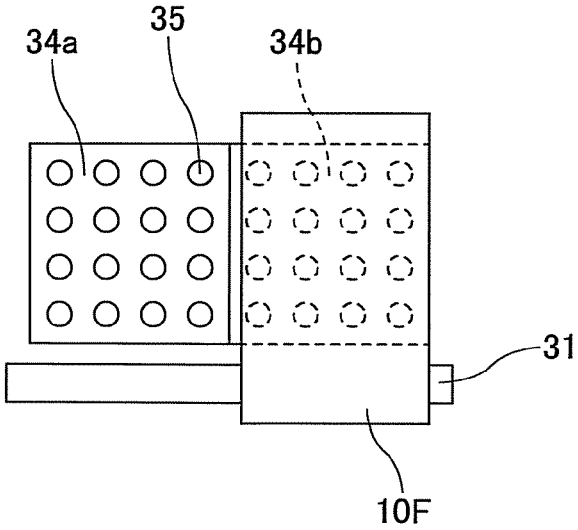
Figure 21A:
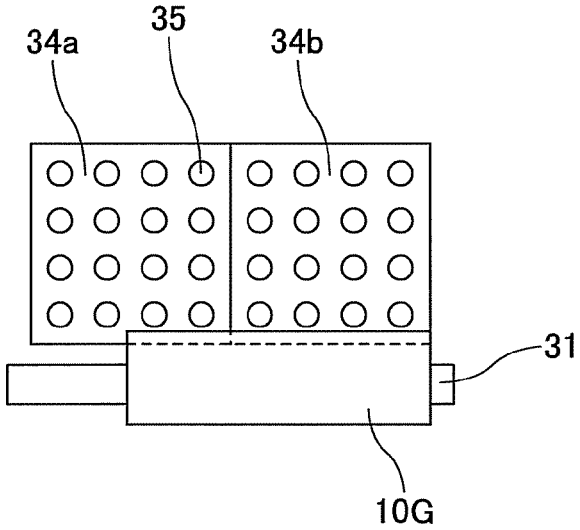
FIGS. 21A through 21C are plan views of the suction conveyance unit for explaining the conveyance operation of a sheet of another size according to the fourth embodiment of the present invention.
Figure 21B:
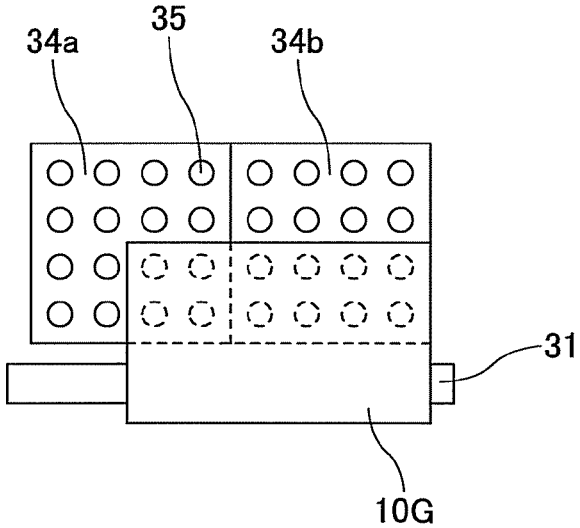
Figure 21C:
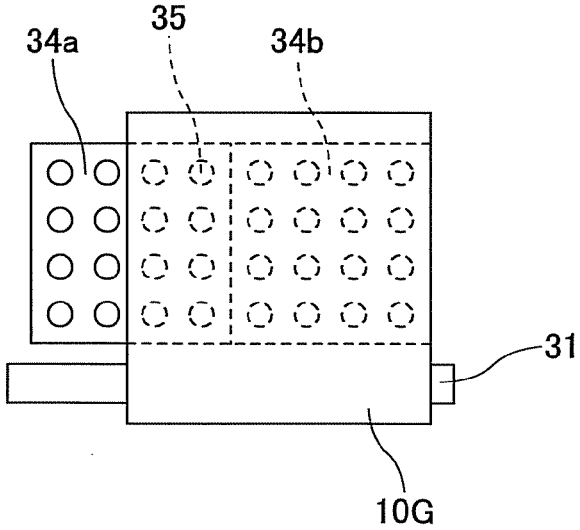

In this embodiment, when a sheet 10F having the length size of A5 as a minimum size is conveyed, the sheet 10F is placed on only the platen 34*b* as shown in FIGS. 20A through 20C. Thus, the suction fan 38*b* is driven, but the suction fans 38*a*1 and 38*a*2 are not driven (stopped). Thus, nearly all the suction holes 35 of the platen member 34*b* are sealed by the sheet 10F. Therefore, a sufficient suction force can be applied to the sheet 10F even with the suction fan having a low maximum static pressure.

Further, when a sheet 10G having a width of 210 mm (having the length size of A4) is conveyed, some of the suction holes 35 of the platen member 34*a* remain open. However, since the suction fans 38*a*1 and 38*a*2 connected to the air chamber 36*a* are arranged in series, a negative pressure in the air chamber 36*a* is easily maintained. Therefore, a sufficient suction force can be applied to the sheet 10G.

As described above, the suction conveyance unit is so configured that the maximum static pressure of the suction unit connected to the air chamber where the suction holes are not sealed when the conveyable medium to be recorded having the minimum width is conveyed is made larger than the maximum static pressure of the suction unit connected to the air chamber where at least some of the suction holes are sealed when the medium is conveyed. With this configuration, in the case of the air chamber where the suction holes in the sheet-width direction are sealed by the sheet of the minimum size, all the suction holes in the sheet-width direction are sealed in most cases when the sheet of a larger size passes over. Therefore, a sufficient suction force can be applied to the medium to be recorded even with the suction unit having the low maximum static pressure. Thus, with the use of the suction unit (e.g., the suction fan) having the low maximum static pressure, a reduction in the consumption power and the noise of the suction unit and the downsizing of the apparatus can be achieved.

Further, the suction conveyance unit is so configured that the number of the suction units connected to the air chambers where the suction holes are not sealed when the conveyable medium to be recorded having the minimum width is conveyed is made larger than the number of the suction units connected to the air chambers where at least some of the suction holes are sealed when the medium is conveyed. With this configuration, in the case of the air chamber where the suction holes in the sheet-width direction are sealed by the sheet of the minimum size, most of the suction holes in the sheet-width direction are sealed when the sheet of a larger size passes through. Therefore, even if the number of the suction units connected to the air chamber is reduced, a negative pressure in the air chamber involved can be sufficiently maintained.

Note that in the above embodiments, the suction conveyance unit is configured to include the separate platen members and the air chambers. However, the plural platen members or the plural air chambers may be configured integrally.

The present invention is not limited to the specifically disclosed embodiments, and variations and modifications may be made without departing from the scope of the present invention.

The present application is based on Japanese Priority Application No. 2009-206390 filed on Sep. 7, 2009, the entire contents of which are hereby incorporated herein by reference.

What is claimed is:

1. An image forming apparatus comprising:

an image forming unit that forms an image; and a conveyance unit that conveys a medium to be recorded opposing the image forming unit;

wherein the conveyance unit includes a platen member that guides the medium to be recorded and has plural suction holes formed therein, plural air chambers that the plural suction holes formed in the platen member face, and plural suction units that suction air inside the plural air chambers through the suction holes, at least two or more of the plural air chambers being arranged in a direction crossing a conveyance direction of the medium to be recorded, one of the plural air chambers being connected to one of the plural suction units and one or two or more of the plural air chambers being connected to at least one of the plural suction units and wherein the plural suction units are separately connected to the plural air chambers, the plural suction units connected to the plural air chambers are identical to one another, the plural suction units are driven by PWM control, and a duty of the suction unit connected to the air chamber where some of the suction holes are sealed by the medium to be recorded is set to be higher than a duty of the suction unit connected to the air chamber where all the suction holes are sealed by the medium to be recorded.

2. The image forming apparatus according to claim 1, wherein the suction unit corresponding to the air chamber where all the suction holes are not sealed by the medium to be recorded is stopped.

3. The image forming apparatus according to claim 1, wherein the plural air chambers are separately provided and are identical to one another.

4. The image forming apparatus according to claim 1, wherein the platen member is configured to include platen regions separately provided so as to correspond to the plural air chambers, and the platen regions are identical to one another.

5. The image forming apparatus according to claim 1, wherein a maximum static pressure of the suction unit connected to the air chamber where the suction holes are not sealed when the conveyable medium to be recorded having a minimum width is conveyed is larger than a maximum static pressure of the suction unit connected to the air chamber where at least some of the suction holes are sealed when the medium is conveyed.

6. The image forming apparatus according to claim 1, wherein the number of the suction units connected to the air chambers where the suction holes are not sealed when the conveyable medium to be recorded having a minimum width is conveyed is larger than the number of the suction units connected to the air chambers where at least some of the suction holes are sealed when the medium is conveyed.

7. An image forming apparatus comprising:

an image forming unit that forms an image; and a conveyance unit that conveys a medium to be recorded opposing the image forming unit;

wherein the conveyance unit includes a platen member that guides the medium to be recorded and has plural suction holes formed therein, plural air chambers that the plural suction holes formed in the platen member face and plural suction units that suction air inside the plural air chambers through the suction holes, at least two or more of the plural air chambers being arranged in a direction crossing a conveyance direction of the medium to be recorded, one of the plural air chambers being connected to one of the plural suction units and one or two or more of the plural air chambers being connected to at least one of the plural suction units, and wherein the plural suction units are separately connected to the plural air chambers, the plural suction units connected to the plural air chambers are identical to one another, and a driving voltage of the suction unit connected to the air chamber where some of the suction holes are sealed by the medium to be recorded is set to be higher than a driving voltage of the suction unit connected to the air chamber where all the suction holes are sealed by the medium to be recorded.

8. An image forming apparatus comprising:

image forming means for forming an image; and conveyance means for conveying a medium to be recorded opposing the image forming means; wherein the conveyance means includes a platen member that guides the medium to be recorded and has plural suction holes formed therein, plural air chambers that the plural suction holes formed in the platen member face, and plural suction means for suctioning air inside the plural air chambers through the suction holes, at least two or more of the plural air chambers being arranged in a direction crossing a conveyance direction of the medium to be recorded, one of the plural air chambers being connected to one of the plural suction means and one or two or more of the plural air chambers being connected to at least one of the plural suction means, and wherein the plural suction means are separately connected to the plural air chambers, the plural suction means connected to the plural air chambers are identical to one another, the plural suction means are driven by PWM control, and a duty of the suction means connected to the air chamber where some of the suction holes are sealed by the medium to be recorded is set to be higher than a duty of the suction means connected to the air chamber where all the suction holes are sealed by the medium to be recorded.

9. An image forming apparatus comprising:

image forming means for forming an image; and conveyance means for conveying a medium to be recorded opposing the image forming means; wherein the conveyance means includes a platen member that guides the medium to be recorded and has plural suction holes formed therein, plural air chambers that the plural suction holes formed in the platen member face, and plural suction means for suctioning air inside the plural air chambers through the suction holes, at least two or more of the plural air chambers being arranged in a direction crossing a conveyance direction of the medium to be recorded, one of the plural air chambers being connected to one of the plural suction means and one or two or more of the plural air chambers being connected to at least one of the plural suction means, and wherein the plural suction means are separately connected to the plural air chambers, the plural suction means connected to the plural air chambers are identical to one another, and a driving voltage of the suction means connected to the air chamber where some of the suction holes are sealed by the medium to be recorded is set to be higher than a driving voltage of the suction means connected to the air chamber where all the suction holes are sealed by the medium to be recorded.

* * * * *